US005562080A

United States Patent [19]

Nishihara et al.

[11] Patent Number: 5,562,080

[45] Date of Patent: Oct. 8, 1996

[54] SYSTEM FOR DETERMINING THE FULLY-CLOSED STATE OF SUBSIDIARY THROTTLE VALVE

[75] Inventors: Takashi Nishihara; Toru Ikeda; Shuji Shiraishi, all of Wako; Osamu Yano, Tochigi, all of Japan

[73] Assignee: Honda Giken Kogyo Kabushiki Kaisha, Tokyo, Japan

[21] Appl. No.: 301,903

[22] Filed: Sep. 7, 1994

[30] Foreign Application Priority Data

Sep. 7, 1993 [JP] Japan ..... 5-222603

[51] Int. Cl.[6] ..... F02D 7/00

[52] U.S. Cl. ..... 123/399

[58] Field of Search ..... 123/399, 336, 123/361, 442, 478, 674; 180/197; 364/426.02, 426.01, 431.04

[56] References Cited

U.S. PATENT DOCUMENTS

| | | | |
|---|---|---|---|
| 4,359,894 | 11/1982 | Ikeura et al. | 73/118 |
| 4,995,364 | 2/1991 | Kamei et al. | 123/442 |
| 5,092,420 | 3/1992 | Suguwara et al. | 123/399 |
| 5,113,823 | 5/1992 | Iriyama | 123/399 |
| 5,151,861 | 9/1992 | Danno et al. | 364/426.02 |

FOREIGN PATENT DOCUMENTS 56-107926 8/1981 Japan .

*Primary Examiner*—Raymond A. Nelli

*Attorney, Agent, or Firm*—Armstrong, Westerman, Hattori, McLeland & Naughton

[57] ABSTRACT

A method for determining the fully-closed state of a subsidiary throttle valve. If a stable state judging circuit judges that there is no outside influence exerted on the operational state of the engine (a state in which the vehicle is stopped and the engine is in an idling state) even if the subsidiary throttle valve is fully closed, a valve closing circuit closes the subsidiary throttle valve and a fully-closed state determination is carried out. If the opening degree of the subsidiary throttle valve or the engine revolution number is largely varied during the determination process of the fully-closed state determination circuit, a valve-closing inhibiting circuit inhibits the closing of the subsidiary throttle valve to discontinue the determination. Even if all of the conditions for determination are satisfied again, the closing of the subsidiary throttle valve and the restarting of determination by the fully-closed state determination circuit are inhibited until the comparator circuit judges that the vehicle starts traveling and vehicle speed exceeds a reference value.

12 Claims, 3 Drawing Sheets

SYSTEM FOR DETERMINING THE FULLY-CLOSED STATE OF SUBSIDIARY THROTTLE VALVE

BACKGROUND OF THE INVENTION

1. Field of the Invention

The present invention relates to a system for determining the fully-closed state of a subsidiary throttle valve disposed in series with a main throttle valve mounted in an intake passage in an engine.

2. Description of the Prior Art

For example, in an engine of a vehicle including a traction control device, a main throttle valve connected to an accelerator pedal and opened and closed by the accelerator pedal, and a subsidiary throttle valve connected to an actuator and opened and closed by the actuator are mounted in series. And when an excessive slipping of a driven wheel occurs, the subsidiary throttle valve is controlled to be closed, thereby reducing the output from the engine to suppress the excessive slipping.

To accurately control the opening degree of the subsidiary throttle valve, it is necessary to correctly detect the opening degree of the subsidiary throttle valve. For this purpose, a system for determining the fully-opened state of the subsidiary throttle valve has been proposed (see Japanese Patent application Laid-open No.107926/81). This prior art system is designed such that when the actuator for opening and closing the subsidiary throttle valve is in a non-energized state and the subsidiary throttle valve is in a fully opened state, the fully opened state is determined by detecting it by a sensor and storing it.

The subsidiary throttle valve is normally in an opened state and is closed when the traction control device is operated. However, the important opening degree of the subsidiary throttle valve for suppressing the excessive slipping of the driven wheel, is near a substantially fully-closed state. For this reason, the system for determining the fully-closed state of the subsidiary throttle valve as in the prior art is accompanied by a problem that it is impossible to carry out an effective determining.

In order to avoid such disadvantage, it may be conceived that the fully-closed state of the subsidiary throttle valve should be determined. However, if the subsidiary throttle valve is brought into a fully-closed state, an influence is exerted to the operational state of the engine and hence, it is necessary to determine the fully-closed state while selecting a particular operational state (e.g., an idling state) in which such influence is minimized. However, even if all of a plurality of conditions in which the engine is in the above-described particular operational state are satisfied and the subsidiary throttle valve is closed to conduct the determining, the closing of the subsidiary throttle valve must be discontinued once whenever any of these conditions not satisfied. And when all of the conditions are satisfied again, the closing of the subsidiary throttle valve is carried out again. Consequently, the actuator for opening and closing the subsidiary throttle valve is intermittently driven, resulting in disadvantages such as generation of a noise, an increase in consumed electric power and the like.

SUMMARY OF THE INVENTION

The present invention has been accomplished with the above circumstance in view, and it is an object of the present invention to correctly and efficiently determine the fully-closed state of the subsidiary throttle valve.

To achieve the above object, according to the invention, a system for determining the fully-closed state of a subsidiary throttle valve disposed in series with a main throttle valve mounted in an intake passage in an engine, comprises the steps of: judging that the engine is in a stable operational state which is not varied even if the subsidiary throttle valve is driven into a fully closed state; closing the subsidiary throttle valve in accordance with a result from the stable state judging step; judging that the variation in opening degree of the subsidiary throttle valve is smaller than a predetermined value by monitoring the opening degree of the subsidiary throttle valve after judgment of the stable state of the engine in the stable state judging step; determining the fully-closed state of the subsidiary throttle valve in accordance with a result from the opening-degree variation judging step.

With the above arrangement, if it is decided that the engine is in a stable operational state which is not varied even if the subsidiary throttle valve is driven into a fully closed state, the subsidiary throttle valve is driven into a fully closed state. When the variation in opening degree of the subsidiary throttle valve is smaller than the predetermined value in such state, when the variation in number of revolutions of the engine is smaller than the predetermined value, or when the purging of the fuel from the canister is stopped, the fully-closed state of the subsidiary throttle valve is determined. Therefore, when the operational state of the engine is suitable for the determining, the determining can be carried out without influencing the operational state of the engine. Moreover, by determining the subsidiary throttle valve in its fully closed state, it is possible to accurately control the opening degree of the subsidiary throttle valve near the fully-closed state, which is important for controlling the output of the engine.

According to the present invention, it is also provided that a system for determining the fully-closed state of a subsidiary throttle valve disposed in series with respect to a main throttle valve mounted in an intake passage in an engine, comprises the steps of: judging that the engine is in a stable operational state which is not varied even if the subsidiary throttle valve is driven into a fully closed state; closing the subsidiary throttle valve in accordance with a result from the stable state judging step; judging that the variation in number of revolutions of the engine is smaller than a predetermined value by monitoring the number of revolutions of the engine after judgment of the stable state of the engine in the stable state judging step; and determining the fully-closed state of the subsidiary throttle valve in accordance with a result from the revolution-number variation judging step.

Also with this arrangement, the same effect as mentioned above can be obtained.

According to the invention, it is further provided that a system for determining the fully-closed state of a subsidiary throttle valve disposed in series with a main throttle valve mounted in an intake passage in an engine, comprises the steps of: judging that the engine is in a stable operational state which is not varied even if the subsidiary throttle valve is driven into a fully closed state; closing the subsidiary throttle valve in accordance with a result from the stable state judging step; judging the stoppage of purging of a fuel by monitoring the purging of the fuel from a canister after judgment of the stable state of the engine in the stable state judging step; and determining the fully-closed state of the subsidiary throttle valve in accordance with a result from the fuel purge judging step.

With this arrangement, the above-mentioned effect can also be obtained.

According to the invention, it is further proposed that a system for determining the fully-closed state of a subsidiary throttle valve disposed in series with a main throttle valve mounted in an intake passage in an engine, comprises the steps of: judging that the engine is in a stable operational state which is not varied even if the subsidiary throttle valve is driven into a fully closed state; closing the subsidiary throttle valve in accordance with a result from the stable state judging step; determining the fully-closed state of the subsidiary throttle valve when the subsidiary throttle valve is fully closed; and inhibiting the valve-closing step until the vehicle speed exceeds a predetermined value, when the stable state judging step does not judge the stable state.

With the arrangement above, if it is decided that the engine is in a stable operational state which is not varied even if the subsidiary throttle valve is driven into a fully closed state, the subsidiary throttle valve is driven into a fully closed state to conduct the determination of the fully-closed opening degree of the subsidiary throttle valve. When the determination is discontinued before completion thereof, the closing of the subsidiary throttle valve is prohibited until the vehicle speed exceeds the predetermined value. Therefore, it is possible to prevent the continuous opening and closing runs of the subsidiary throttle valve to inhibit the generation of a noise and an increase in consumed power.

The above and other objects, features and advantages of the invention will be apparent from the following description of preferred embodiments taken in conjunction with the accompanying drawings.

DESCRIPTION OF THE PREFERRED EMBODIMENT

The present invention will now be described by way of a preferred exemplary embodiment in connection with the accompanying drawings.

Figure 1:
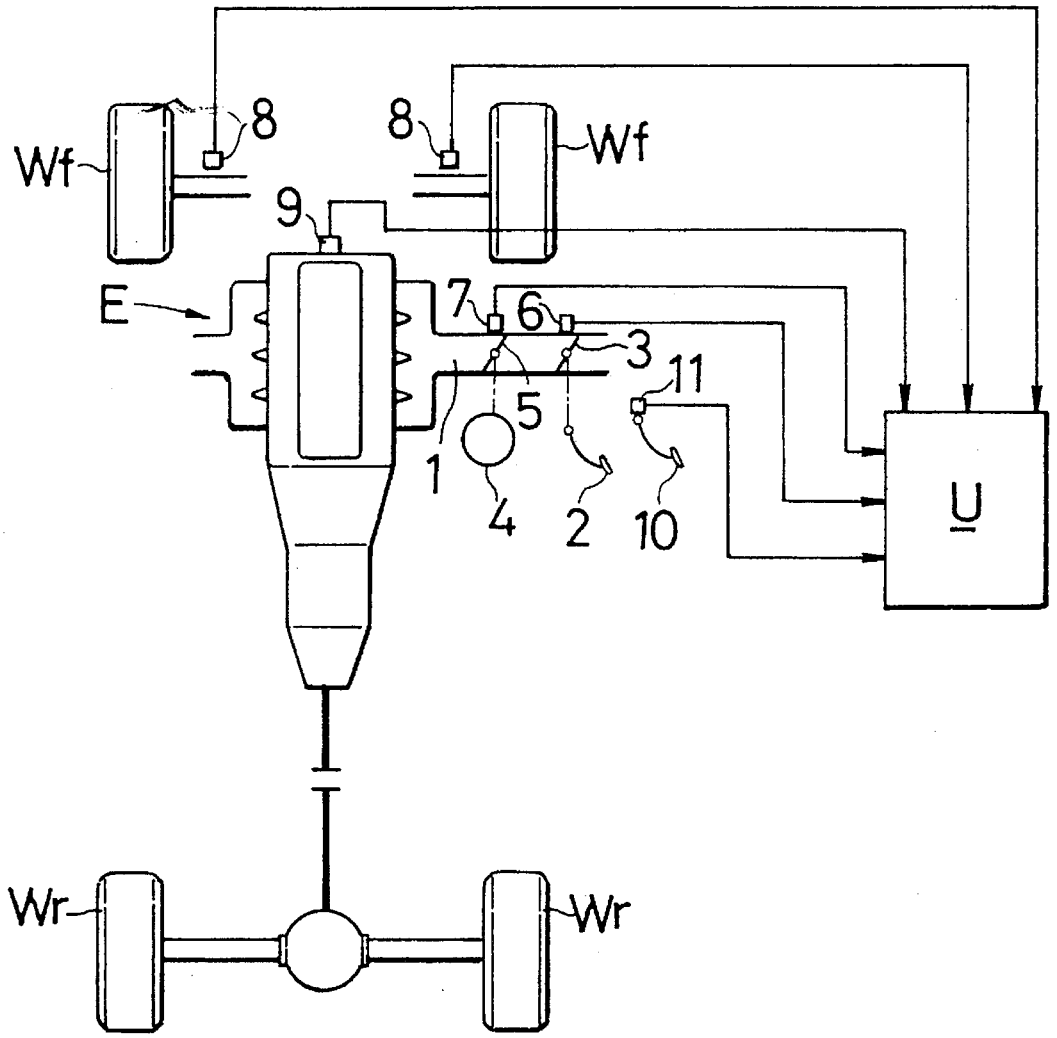
FIG. 1 is a schematic illustration of an arrangement of a vehicle including a fully-closed state determining system for a subsidiary throttle valve.
Figure 2:
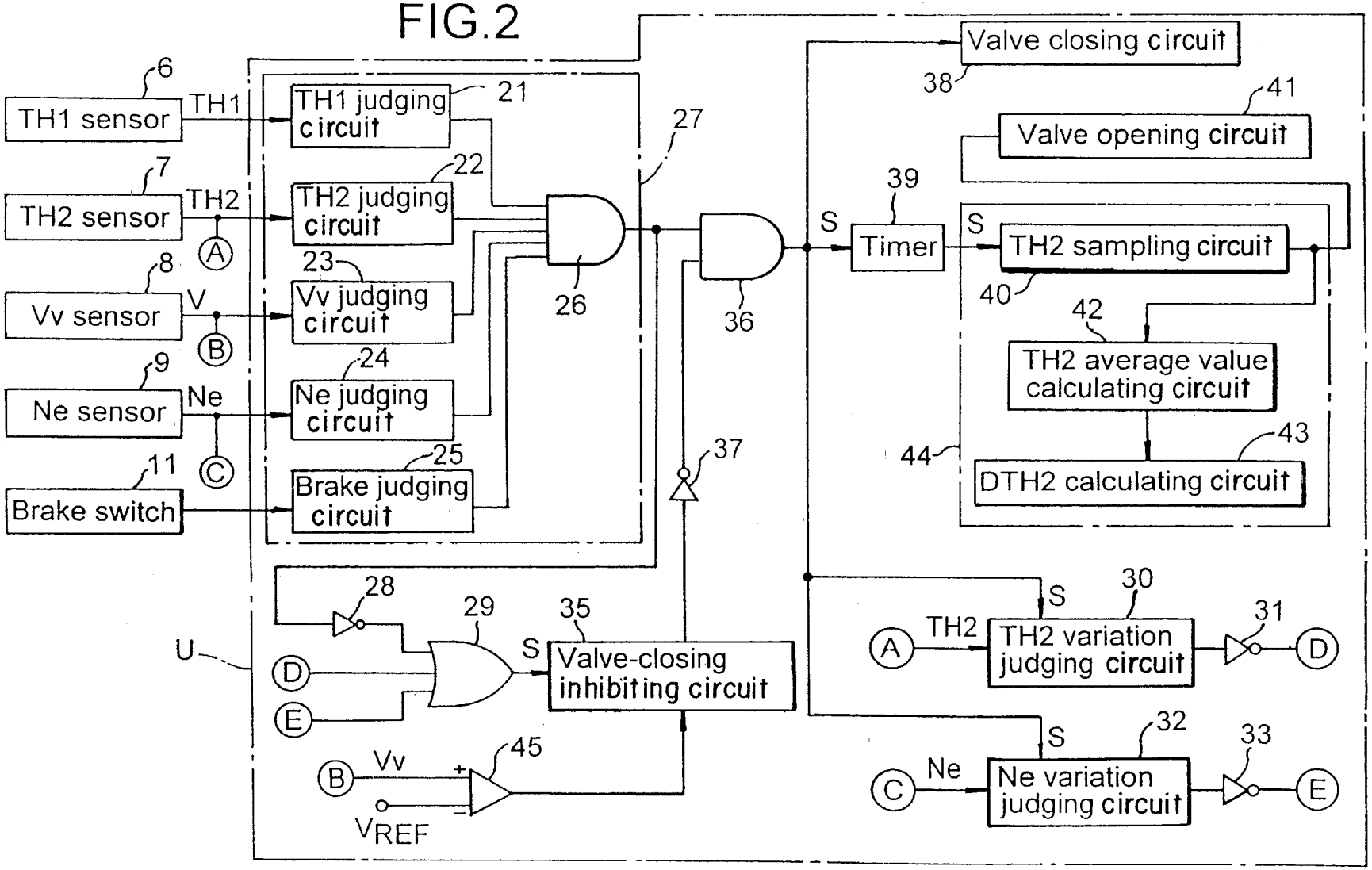
FIG. 2 is a block diagram of the fully-closed state determining system for the subsidiary throttle valve.

FIGS. 1 to 3 illustrate a preferred exemplary embodiment of the present invention.

As shown in FIG. 1, provided in series in an intake passage 1 of an engine E carried on a vehicle are a main throttle valve 3 connected to and opened and closed by an accelerator pedal 2, and a subsidiary throttle valve 5 connected to and opened and closed by an actuator 4 such as a pulse motor or the like. A main throttle valve opening-degree sensor 6 is provided on the main throttle valve 3, and a subsidiary throttle valve opening-degree sensor 7 is provided on the subsidiary throttle valve 5. The main throttle valve opening-degree sensor 6 detects an opening degree of the main throttle valve 3 in terms of a voltage value and outputs an A/D conversion value of the detected voltage value. The subsidiary throttle valve opening-degree sensor 7 detects an opening degree of the subsidiary throttle valve 5 in terms of a voltage value and outputs an A/D conversion value of the detected voltage value.

The vehicle includes a pair of left and right driven wheels Wr, Wr driven from the engine E and a pair of left and right follower wheels Wf, Wf. Vehicle speed sensors 8, 8 are provided on the follower wheels Wf, Wf for detecting a vehicle speed Vv from the number of revolutions of the follower wheels Wf, Wf, respectively. An engine revolution number sensor 9 is provided on the engine E for detecting the number of revolutions of the engine E, and a brake switch 11 is provided on the brake pedal 10 for detecting the operation of the brake pedal 10.

Outputs from the main throttle valve opening-degree sensor 6, the subsidiary throttle valve opening-degree sensor 7, the vehicle speed sensors 8, 8, the engine revolution-number sensor 9 and the brake switch 11 are supplied to an electronic control unit U, where a zero-point correction is carried out by determining the fully-closed state of the subsidiary throttle valve opening-degree sensor 7. More specifically, it is possible to accurately detect an actual opening degree of the subsidiary throttle valve 5 by determining an output value from the subsidiary throttle valve opening-degree sensor 7 when the subsidiary throttle valve 5 is in its fully closed state, and by subtracting the determined value as a zero-point correction value from the output value from the subsidiary throttle valve opening-degree sensor 7. A procedure for determining the zero-point correction value will be described below in detail.

FIG. 2 illustrates the arrangement of a circuit in the electronic control unit U. An output value TH1 (an A/D conversion value) from the main throttle valve opening degree sensor 6 is supplied to a main throttle opening degree judging circuit 21, where the output value TH1 is compared with a reference value. If the output value TH1 is equal to or less than the reference value, i.e., if the main throttle valve 3 is in a substantially fully closed position, then an output from the main throttle opening degree judging circuit 21 is of a high level. An output value TH2 (an A/D conversion value) from the subsidiary throttle valve opening-degree sensor 7 is supplied to a subsidiary throttle opening-degree judging circuit 22. If the output value TH2 is within a predetermined acceptable range and does not indicate an abnormal value, then an output from the subsidiary throttle opening-degree judging circuit 22 is of a high level.

The vehicle speed Vv delivered by the vehicle speed sensors 8, 8 is supplied to a vehicle speed judging circuit 23. If it is decided in the vehicle speed judging circuit 23 that the vehicle speed Vv is 0 (i.e., the vehicle is in a stopped state), an output from the vehicle speed judging circuit 23 is brought into a high level. An engine-revolution number Ne delivered by the engine-revolution number sensor 9 is supplied to an engine-revolution number judging circuit 24. If it is decided in the engine-revolution number judging circuit 24 that the engine-revolution number Ne is, for example, within a range of 600 to 700 rpm, and the engine E is in an idling state, then an output from the engine-revolution number judging circuit 24 is of a high level. When the brake pedal 10 is depressed to turn ON the brake switch 11, an output from a brake judging circuit 25 is brought into a high level.

The outputs from the main throttle opening-degree judging circuit 21, the subsidiary throttle opening-degree judging circuit 22, the vehicle speed judging circuit 23, the engine-revolution number judging circuit 24 and the brake judging circuit 25 are supplied to an AND circuit 26. An output from the AND circuit 26 is brought into a high level, if all of the outputs from the judging circuit 21 to 25 are of high levels, i.e., if the brake pedal 10 has been depressed so that the vehicle is in its stopped state, and the main throttle valve 3 has been in the substantially fully closed state, so that the engine E is in its idling state, and it is decided that the output from the subsidiary throttle valve opening-degree sensor 7 is normal and as a result, even if the subsidiary throttle valve 5 is closed, the operational state of the engine E is not influenced in any way.

The main throttle opening-degree judging circuit 21, the subsidiary throttle opening-degree judging circuit 22, the vehicle speed judging circuit 23, the engine-revolution number judging circuit 24, the brake judging circuit 25 and the AND circuit 26 constitute a stable-state judging circuit 27 of the embodiment.

The output from the AND circuit 26 is supplied through a NOT circuit 28 to an OR circuit 29. Further, an output from a subsidiary throttle valve opening-degree variation judging circuit 30 which will be described hereinafter is supplied through a NOT circuit 31 to the OR circuit 29. And an output from an engine revolution-number variation judging circuit 32 which will be described hereinafter is supplied through a NOT circuit 33 to the OR circuit 29.

Thus, if it is decided that the operational state of the engine is influenced when the output from the stable-state judging circuit 27 is of a low level and the subsidiary throttle valve 5 is closed, or if the output from the subsidiary throttle valve opening-degree variation judging circuit 30 is of a low level, thereby indicating that the opening degree TH2 of the subsidiary throttle valve has been varied, or if the output from the engine revolution-number variation judging circuit 32 is of a low level, thereby indicating that the engine revolution-number Ne has been varied, an output from the OR circuit 29 is brought into a high level. If the output from the OR circuit 29 has reached the high level, an output from a valve-closing inhibiting circuit 35 is brought into a high level to prohibit the closing of the subsidiary throttle valve 5.

The output from the valve-closing inhibiting circuit 35 is supplied through a NOT circuit 37 to an AND circuit 36 connected to the stable-state judging circuit 27. Thus, if it is decided that the output from the stable-state judging means 27 is of a high level and the operational state of the engine E is not influenced even if the subsidiary throttle valve 5 is closed, and if it is decided that the output from the valve-closing prohibiting circuit 35 is of a low level and it is not necessary to prohibit the closing of the subsidiary throttle valve 5, an output from the AND circuit 36 is brought into a high level.

When the output from the AND circuit 36 has reached the high level, a valve closing circuit 38 closes the subsidiary throttle valve 5 toward a fully closed position through the actuator 4. The closing of the subsidiary throttle valve 5 is achieved by closing it through a predetermined angle (e.g., 2°) for every loop. When the output from the AND circuit 36 has reached the high level, a timer 39 starts counting. After the subsidiary throttle valve 5 becomes fully closed after a lapse of a predetermined time, the opening degree TH2 of the subsidiary throttle valve 5 is sampled in a subsidiary throttle valve opening-degree sampling circuit 40 for every loop, until a further predetermined time is lapsed. If the timer has reached a time-up to complete a predetermined number of samplings, a valve-opening circuit 41 opens the subsidiary throttle valve 5 toward an original position through the actuator 4.

A subsidiary throttle valve opening-degree average value calculating circuit 42 calculates an average value from a plurality of opening degrees TH2 of the subsidiary throttle valve 5 in the sampled and fully closed state, and a zero-point correction value calculating circuit 43 calculates a zero-point correction value DTH2 by subtracting the average value from the reference value for the fully-closed state degree. Thus, the zero-point correction of the subsidiary throttle valve opening-degree sensor 7 can be performed by using, as an opening degree of the subsidiary throttle valve 5, a value resulting from the subtraction of the zero-point correction value DTH2 from the output value TH2 (A/D conversion value) from the subsidiary throttle valve opening-degree sensor 7.

The subsidiary throttle valve opening-degree sampling circuit 40, the subsidiary throttle valve opening-degree average value calculating circuit 42 and the zero-point correction value calculating circuit 43 constitute a fully-closed state determination circuit 44 of the present invention.

Thus, it is possible to perform an accurate control of the opening degree near the substantially fully-closed state of the subsidiary throttle valve 5, which is important for the control of an output from the engine E, by conducting the zero-point correction by determining the subsidiary throttle valve opening degree TH2 when the subsidiary throttle valve 5 is in the fully closed state.

The AND circuit 36 is connected to a set terminal of the subsidiary throttle valve opening-degree variation judging circuit 30 to which a signal from the subsidiary throttle valve opening-degree sensor 7 is applied. When a signal from the AND circuit 36 is applied to such set terminal simultaneously with the start of the closing of the subsidiary throttle valve 5, the monitoring of a variation range for the subsidiary throttle valve opening degree TH2 is started. If this variation range is equal to or less than a predetermined value, an output from the subsidiary throttle valve opening-degree variation judging circuit 30 is brought into a high level. The AND circuit 36 is also connected to a set terminal of the engine revolution-number variation judging circuit 32 to which a signal from the engine revolution-number sensor 9 is simultaneously applied. When the signal from the AND circuit 36 is applied to such set terminal simultaneously with the start of the closing of the subsidiary throttle valve 5, the monitoring of a variation range for the engine-revolution number is started. If this variation range is equal to or less than a predetermined value, an output from the engine revolution-number variation judging circuit 32 is brought into a high level. The outputs from the subsidiary throttle valve opening-degree variation judging circuit 30 and the engine revolution-number variation judging circuit 32 are supplied through the corresponding NOT circuits 31 and 33 to the OR circuit 29. If the variation in the subsidiary throttle valve opening degree TH2 is large, or if the variation in engine revolution-number Ne is large, then the closing of the subsidiary throttle valve 5 is discontinued.

Now, if the output from the stable-state judging circuit 27 is brought into a low level, or if the output from the subsidiary throttle valve opening-degree variation judging means 30 or the engine revolution-number variation judging circuit 32 is brought into a low level, a high level output from the OR circuit 29 is applied to a set terminal of the valve-closing inhibiting circuit 35 comprised of a flip-flop circuit. If an output from the valve-closing inhibiting circuit 35 is brought into a high level, the determination of the fully-closed state for the subsidiary throttle valve 5 is discontinued. Thereafter, even if the outputs from the stable-state judging circuit 27, the subsidiary throttle valve opening-degree variation judging circuit 30 or the engine revolution-number variation judging circuit 32 is restored to the high level, the output from the valve-closing inhibiting circuit 35 is maintained at the high level until a signal is supplied to a reset terminal thereof, and the determination once discontinued is not restarted.

However, the vehicle speed Vv from the vehicle speed sensors 8, 8 is supplied to a non-inverted terminal of the comparator circuit 45 connected to the reset terminal of the valve-closing inhibiting circuit 35, and a predetermined reference value $V_{REF}$ has been inputted to an inverted terminal of the valve-closing inhibiting circuit 35. If the vehicle speed Vv exceeds the reference value $V_{REF}$ and a high level signal is applied to the reset terminal, the output from the valve-closing inhibiting means 35 is reset at a low level, thereby starting the determination. If the determination is once discontinued, the determination is not restarted until the vehicle speed Vv exceeds the reference value $V_{REF}$. If determination conditions are met after the vehicle speed Vv has exceeded the reference value $V_{REF}$, the determination is restarted.

This will be further described with reference to FIG. 3. Even if all of the determination conditions have been satisfied during stoppage of the vehicle and the subsidiary throttle valve 5 has been closed to determine the fully closed state, the subsidiary throttle valve 5 is opened whenever any of the determination conditions are not satisfied before completion of the determination. Provided that the subsidiary throttle valve 5 is thereafter closed to restart the determination when all of the determination conditions are satisfied again, a plurality of opening and closing runs of the subsidiary throttle valve 5 may be continuously repeated, as shown in FIG. 3A. If the opening and closing runs of the subsidiary throttle valve 5 are repeated in this manner, not only an influence is exerted to the control of the engine E, but also problems arise such as the generation of a noise, and an increase in power consumption.

Figures 3A, 3B:
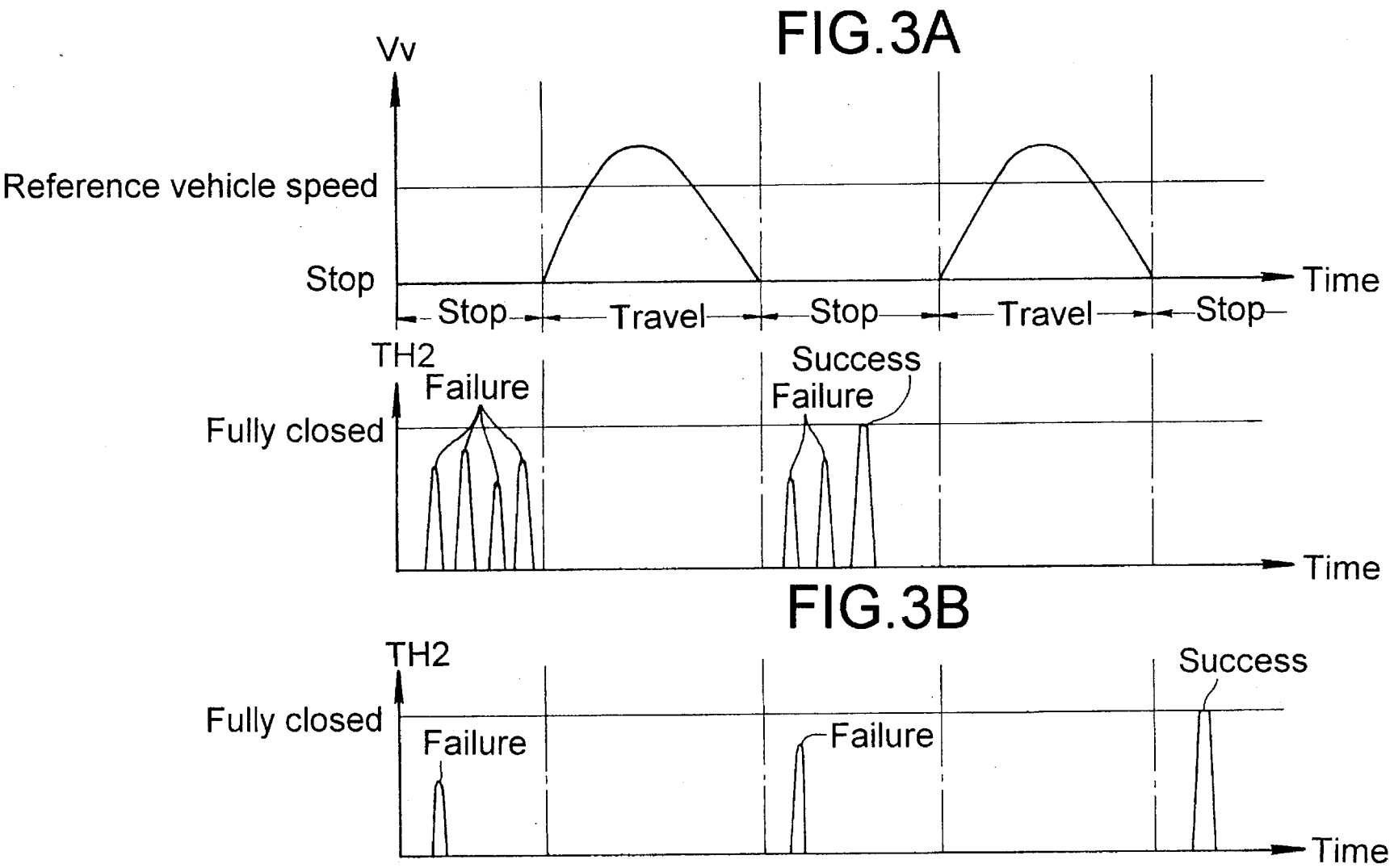
FIGS. 3A & 3B are a diagram for explaining the operation.

According to the preferred embodiment, however, if the determination conditions are dissatisfied before completion of the determination, as shown in FIG. 3B, the vehicle is stopped again after the vehicle speed Vv once exceeds the reference value $V_{REF}$, and the determination is restarted until the determination conditions are satisfied, i.e., only one run of the determination is conducted for every one run of stoppage of the vehicle. Thus, it is possible to obviate the continuously opening and closing movements of the subsidiary throttle valve 5.

Although the present invention has been described in detail, it will be understood that the present invention is not limited to the above-described embodiment, and various modifications in design can be made without departing from the spirit and scope of the invention defined in claims.

For example, in the embodiment, the variation in engine revolution-number Ne is monitored by the engine revolution-number variation judging circuit 32. If the variation is small, the determination is conducted. If the variation is large, the determination is discontinued. In place of direct monitoring of the engine revolution-number Ne, the purging of a canister for adsorbing fuel evaporated from a fuel tank may be monitored. Specifically, if the evaporated fuel is being purged from the canister into the intake passage 1 in the engine E, the air-fuel ratio is liable to be varied to vary the engine revolution-number Ne. For this reason, the determination may be conducted during suspension of the purging, and may be discontinued during execution of the purging.

What is claimed is:

1. A method using a memory in a microprocessor for determining a reference signal level corresponding to a fully-closed state of a subsidiary throttle valve which is disposed in series with a main throttle valve mounted in an intake passage of an engine for a vehicle, the method comprising the steps of:

detecting an opening degree of said subsidiary throttle valve by a level of a signal outputted from a subsidiary throttle valve opening degree sensor associated with said subsidiary throttle valve;

detecting whether the engine is in a stable operational state which is not varied even if the subsidiary throttle valve is driven into the fully closed state, said stable operation state of the engine being detected when predetermined conditions are satisfied, said predetermined conditions including a condition in which a vehicle speed is zero and a condition in which a number of revolutions of the engine is of a low level;

fully closing the subsidiary throttle valve when it is detected that the engine is in the stable operational state;

detecting whether a variation in the signal level indicative of the opening degree of the subsidiary throttle valve is smaller than a predetermined value by monitoring said signal level after detecting that the engine is in the stable operational state;

when it is detected that the variation in the signal level indicative of the opening degree of the subsidiary throttle valve is smaller than said predetermined value, determining the reference signal level corresponding to the fully-closed state of the subsidiary throttle valve based on the signal level obtained when said subsidiary throttle valve is driven into said fully-closed state, and storing said determined reference signal level corresponding to the fully-closed state in the memory of the microprocessor; and when said engine is detected to be not in said stable operational state, prohibiting said step of determining the reference signal level corresponding to the fully-closed state of the subsidiary throttle valve.

2. A method using a memory in a microprocessor for determining a reference signal level corresponding to a fully-closed state of a subsidiary throttle valve which is disposed in series with a main throttle valve mounted in an intake passage of an engine for a vehicle, the method comprising the steps of:

detecting an opening degree of said subsidiary throttle valve by a level of a signal outputted from a subsidiary throttle valve opening degree sensor associated with said subsidiary throttle valve;

detecting whether the engine is in a stable operational state which is not varied even if the subsidiary throttle valve is driven into the fully closed state, said stable operational state of the engine being detected when predetermined conditions are satisfied, said predetermined conditions including a condition in which a vehicle speed is zero and a condition in which a number of revolutions of the engine is of a low level;

fully closing the subsidiary throttle valve when it is detected that the engine is in the stable operational state;

detecting whether a variation in the number of revolutions of the engine is smaller than a predetermined value by monitoring said number of revolutions of the engine after detecting that the engine is in the stable operational state;

when it is detected that the variation in the number of revolutions of the engine is smaller than said predetermined value, determining the reference signal level corresponding to the fully-closed state of the subsidiary throttle valve based on the signal level obtained when said subsidiary throttle valve is driven into said fully-closed state, sand storing said determined reference signal level corresponding to the fully-closed state in the memory of the microprocessor; and when said engine is detected to be not in said stable operational state, prohibiting said step of determining the reference signal level corresponding to the fully-closed state of the subsidiary throttle valve.

3. A method using a memory in a microprocessor for determining a reference signal level corresponding to a fully-closed state of a subsidiary throttle valve which is disposed in series with a main throttle valve mounted in an intake passage of an engine for a vehicle, the method comprising the steps of:

detecting an opening degree of said subsidiary throttle valve by a level of a signal outputted from a subsidiary throttle valve opening degree sensor associated with said subsidiary throttle valve;

detecting whether the engine is in a stable operational state which is not varied even if the subsidiary throttle valve is driven into the fully closed state, said stable operational state of the engine being detected when predetermined conditions are satisfied, said predetermined conditions including a condition in which a vehicle speed is zero and a condition in which a number of revolutions of the engine is of a low level;

fully closing the subsidiary throttle valve when it is detected that the engine is in the stable operational state;

detecting a stoppage of purging of a fuel by monitoring the purging of the fuel from a canister after detecting that the engine is in the stable operational state;

when the stoppage of purging of the fuel is detected, determining the reference signal level corresponding to the fully-closed state of the subsidiary throttle valve based on the signal level obtained when said subsidiary throttle valve is driven into said fully-closed state, and storing said determined reference signal level corresponding to the fully-closed state in the memory of the microprocessor; and when said engine is detected to be not in said stable operational state, prohibiting said step of determining the reference signal level corresponding to the fully-closed state of the subsidiary throttle valve.

4. A method using a memory in a microprocessor for determining a reference signal level corresponding to a fully-closed state of a subsidiary throttle valve which is disposed in series with a main throttle valve mounted in an intake passage of an engine for a vehicle, the method comprising the steps of:

detecting an opening degree of said subsidiary throttle valve by a level of a signal outputted from a subsidiary throttle valve opening degree sensor associated with said subsidiary throttle valve;

detecting whether the engine is in a stable operational state which is not varied even if the subsidiary throttle valve is driven into the fully closed state, said stable operational state of the engine being detected when predetermined conditions are satisfied, said predetermined conditions including a condition in which a vehicle speed is zero and a condition in which a number of revolutions of the engine is of a low level;

fully closing the subsidiary throttle valve when it is detected that the engine is in the stable operation state;

determining the reference signal level corresponding to the fully-closed state of the subsidiary throttle valve based on the signal level obtained when said subsidiary throttle valve is driven into said fully-closed state, and storing said determined reference signal level corresponding to the fully-closed state in the memory of the microprocessor; and when said engine is detected to be not in said stable operational state, prohibiting full-closing of the subsidiary throttle valve until said vehicle speed exceeds a predetermined value.

5. The method according to claim 1, further comprising the step of obtaining said reference signal level by averaging a plurality of signal levels outputted from said subsidiary throttle valve opening degree sensor during said fully-closed state of the subsidiary throttle valve.

6. The method according to claim 2, further comprising the step of obtaining said reference signal level by averaging a plurality of signal levels outputted from said subsidiary throttle valve opening degree sensor during said fully-closed state of the subsidiary throttle valve.

7. The method according to claim 3, further comprising the step of obtaining said reference signal level by averaging a plurality of signal levels outputted from said subsidiary throttle valve opening degree sensor during said fully-closed state of the subsidiary throttle valve.

8. The method according to claim 4, further comprising the step of obtaining said reference signal level by averaging a plurality of signal levels outputted from said subsidiary throttle valve opening degree sensor during said fully-closed state of the subsidiary throttle valve.

9. The method according to claim 1, wherein said predetermined conditions for the stable operation state of the engine include a condition in which an opening degree of a main throttle valve is of a low level; a condition in which the opening degree of said subsidiary throttle valve is in a predetermined range; and a condition in which the vehicle is braked.

10. The method according to claim 2, wherein said predetermined conditions for the stable operational state of the engine include a condition in which an opening degree of a main throttle valve is of a low level; a condition in which the opening degree of said subsidiary throttle valve is in a predetermined range; and a condition in which the vehicle is braked.

11. The method according to claim 3, wherein said predetermined conditions for the stable operational state of the engine include a condition in which an opening degree of a main throttle valve is of a low level; a condition in which the opening degree of said subsidiary throttle valve is in a predetermined range; and a condition in which the vehicle is braked.

12. The method according to claim 4, wherein said predetermined conditions for the stable operational state of the engine include a condition in which an opening degree of a main throttle valve is of a low level; a condition in which the opening degree of said subsidiary throttle valve is in a predetermined range; and a condition in which the vehicle is braked.

* * * * *